US010815612B2

(12) United States Patent
Tanii

(10) Patent No.: US 10,815,612 B2
(45) Date of Patent: Oct. 27, 2020

(54) CLOTH SPREADING DEVICE

(71) Applicant: PUREX Co., Ltd., Kagawa (JP)

(72) Inventor: Tomoyuki Tanii, Kagawa (JP)

(73) Assignee: PUREX CO., LTD., Kagawa (JP)

( * ) Notice: Subject to any disclaimer, the term of this patent is extended or adjusted under 35 U.S.C. 154(b) by 707 days.

(21) Appl. No.: 15/321,618

(22) PCT Filed: Jul. 13, 2015

(86) PCT No.: PCT/JP2015/003519
§ 371 (c)(1),
(2) Date: Dec. 22, 2016

(87) PCT Pub. No.: WO2016/017090
PCT Pub. Date: Feb. 4, 2016

(65) Prior Publication Data

US 2017/0204555 A1 Jul. 20, 2017

(30) Foreign Application Priority Data

Jul. 31, 2014 (JP) ..... 2014-156121

(51) Int. Cl.
*D06F 67/04* (2006.01)
*D06C 3/00* (2006.01)

(52) U.S. Cl.
CPC ..... *D06F 67/04* (2013.01); *D06C 3/00* (2013.01)

(58) Field of Classification Search
CPC ..... D06F 67/04; D06C 3/00; D06C 3/04
(Continued)

(56) References Cited

U.S. PATENT DOCUMENTS 4,313,269 A * 2/1982 van Rumpt ..... B65G 9/00 38/143
4,979,868 A * 12/1990 Ueda ..... B61B 10/025 38/12

(Continued)

FOREIGN PATENT DOCUMENTS

EP 1820894 A 8/2007
JP H05-293299 A 11/1993

(Continued)

OTHER PUBLICATIONS

Partial Translation of JP 2008-240179 A (para 0021, 0037, 0054).*

(Continued)

*Primary Examiner* — Nathan E Durham

(57) ABSTRACT

To provide a cloth spreading device capable of operating stably. The cloth spreading device includes: introduction chucks 21, 21 in a pair that grip corner portions of a cloth C; an up and down moving device 23 that moves the introduction chucks 21, 21 in a pair up and down; extension chucks 31, 31 in a pair that receive the cloth C from the introduction chucks 21, 21 in a pair and grip corner portions of the cloth C; and a transversely moving device 34 that moves the extension chucks 31, 31 in a pair transversely. The up and down moving device 23 is driven by an actuator permitting speed control and position control. Thus, an external factor does not cause large change in the operation of the up and down moving device 23 to achieve stable upward and downward moving operations of the introduction chucks 21, 21. The introduction chucks 21, 21 can be moved and stopped at will. This eliminates the need for a position sensor to achieve reduction in facility cost.

1 Claim, 11 Drawing Sheets

(58) Field of Classification Search
USPC ..... 38/143; 223/61
See application file for complete search history.

(56) References Cited

U.S. PATENT DOCUMENTS 5,168,645 A * 12/1992 Robin ..... D06F 95/00 198/465.4
5,169,282 A * 12/1992 Ueda ..... D06F 67/04 38/7
5,440,810 A * 8/1995 Borucki ..... D06F 67/04 38/143
6,584,711 B1 * 7/2003 Nakamura ..... D06F 67/04 38/143
6,826,856 B1 * 12/2004 McCabe ..... D06F 67/04 38/143
8,732,995 B2 * 5/2014 Herzog ..... D06F 67/04 38/143
2006/0191170 A1 * 8/2006 Jensen ..... D06F 67/04 38/143
2015/0284899 A1 * 10/2015 Garrone ..... D06F 67/04 38/143

FOREIGN PATENT DOCUMENTS

JP 2006-149491 A 6/2006
JP 2007-092255 A 4/2007
JP 2008-240179 A 10/2008
JP 2009-019285 A 1/2009

OTHER PUBLICATIONS

International Search Report for PCT/JP2015/003519, dated Oct. 13, 2015.
International Preliminary Report on Patentability for PCT/JP2015/003519, dated Dec. 14, 2016.

* cited by examiner (II)

(I)

(IV)

(III)

(VI)

(V)

(1)

(2)

(3)

(4)

(5)

(6)

(1)

(2)

(3)

(4)

(5)

(6)

CLOTH SPREADING DEVICE

TECHNICAL FIELD

This invention relates to a cloth spreading device. More specifically, this invention relates to a cloth spreading device for spreading a cloth such as a washed sheet or towel and introducing the spread cloth into a processing device to be used in a subsequent step.

BACKGROUND ART

Abundant clothes such as sheets and towels are used in hotels or hospitals, etc. The used clothes are generally collected, and then washed, ironed, and folded in laundry factories. Then, these clothes are carried into hotels or hospitals, etc. and used in such places again.

Linen facilities installed in a laundry factory include one that is configured as a set of a cloth spreading device, a roll ironer, and a folding machine. In such a linen facility, the input side of the roll ironer is connected to the output side of the cloth spreading device and the input side of the folding machine is connected to the output side of the roll ironer. In this way, these structures form a process line. If a washed cloth is introduced into the cloth spreading device, the cloth is neatly arranged into shape without a slack. Then, the cloth is ironed by the roll ironer and folded by the folding machine.

A cloth spreading device disclosed in patent literature 1 includes an introduction unit for a cloth and an extension unit that extends the cloth to the right and left. The introduction unit includes introduction chucks in a pair that grip corner portions at opposite ends of one side of a cloth, and an up and down moving device that moves the chucks up and down. The extension unit includes extension chucks in a pair, and a transversely moving device that moves the extension chucks transversely and independently.

The operation of the aforementioned conventional cloth spreading device is described below based on FIGS. 9 to 11.

(1) Introduction chucks 121, 121 are initially on standby at a low position a. A worker finds corner portions at opposite ends of one side of a cloth C and makes the introduction chucks 121, 121 grip the corresponding corner portions.

(2) Then, the introduction chucks 121, 121 move up from the low position a to an intermediate stop position b and stop temporarily at the position b. This is intended to prevent interference with the introduction chucks 121, 121 by extension chucks 131 that are to move transversely in (3).

(3) Next, the extension chucks 131, 131 move transversely to a transfer position above the introduction chucks 121, 121.

(4) Then, the introduction chucks 121, 121 move up from the intermediate stop position b to a high position c. During this movement, the cloth C is transferred from the introduction chucks 121, 121 to the extension chucks 131, 131.

(5) Next, the extension chucks 131, 131 in a pair move to be separated to the right and left to extend the cloth C. Then, the cloth C is transferred to a subsequent mechanism.

(6) The introduction chucks 121, 121 thereafter return to the low position a to be brought to a state of accepting introduction of a next cloth C.

The conventional cloth spreading device uses an air cylinder as the up and down moving device that moves the introduction chucks 121, 121 up and down. Unfortunately, the operation of the air cylinder is changed, for example by the situation of an air compressor. Still unfortunately, the operating speed of the air cylinder is also changed by a load. For example, a sheet and a quilt cover differ in weight. Such different types of clothes C make the air cylinder operate at different speeds. Such unstable operation of the air cylinder causes the probability of the occurrence of operation failure in the cloth spreading device. Further, executing position control, for example for stopping the introduction chucks 121, 121 at the intermediate stop position b, requires a position sensor. This causes an additional problem in terms of increase in facility cost.

CITATION LIST

Patent Literature

Patent Literature 1: Japanese Patent Application Publication No. 2009-19285

SUMMARY OF INVENTION

Technical Problem

In view of the aforementioned circumstances, this invention is intended to provide a cloth spreading device capable of operating stably.

Solution to Problem

A cloth spreading device according to a first invention includes: introduction chucks in a pair that grip corner portions of a cloth; an up and down moving device that moves the introduction chucks in a pair up and down; extension chucks in a pair that receive the cloth from the introduction chucks in a pair and grip corner portions of the cloth; and a transversely moving device that moves the extension chucks in a pair transversely, wherein the up and down moving device is driven by an actuator permitting speed control and position control.

The cloth spreading device according to a second invention is characterized in that, in the first invention, the cloth spreading device includes a controller that controls the operation of the up and down moving device and the operation of the transversely moving device, and the controller operates the up and down moving device and the transversely moving device simultaneously to move up the introduction chucks from an introduction position to a transfer position and to move the extension chucks transversely to the transfer position, thereby transferring the cloth from the introduction chucks to the extension chucks.

The cloth spreading device according to a third invention is characterized in that, in the first or second invention, the cloth spreading device includes a controller that controls the operation of the up and down moving device and the operation of the transversely moving device, and the controller operates the up and down moving device and the transversely moving device simultaneously to move up the introduction chucks from a transfer position and to move the extension chucks transversely from the transfer position, thereby spreading the cloth.

The cloth spreading device according to a fourth invention is characterized in that, in the first, second, or third invention, the cloth spreading device includes: a controller that controls the operation of the up and down moving device; and an input device for input of an introduction position to the controller, the introduction position being a position where the cloth is gripped by the introduction chucks, and the controller controls the operation of the up and down moving device to place the introduction chucks on standby at the introduction position during introduction of the cloth.

Advantageous Effects of Invention

According to the first invention, the up and down moving device is driven by the actuator permitting speed control and position control. Thus, an external factor does not cause large change in the operation of the up and down moving device to achieve stable upward and downward moving operations of the introduction chucks. Further, the introduction chucks can be moved and stopped at will. This eliminates the need for a position sensor to achieve reduction in facility cost.

According to the second invention, the introduction chucks and the extension chucks can be operated simultaneously for arrival at the transfer position. Thus, no wasting time is generated from introduction of a cloth to transfer of the cloth, thereby increasing a processing speed.

According to the third invention, the introduction chucks and the extension chucks can be operated simultaneously for movement from the transfer position. Thus, no wasting time is generated from transfer of a cloth to spreading of the cloth, thereby increasing a processing speed.

According to the fourth invention, the introduction position can be adjusted so as to conform to the height of a worker. This can reduce a workload on the worker.

DESCRIPTION OF EMBODIMENTS

Embodiment of this invention will be described next based on the drawings.

First Embodiment

Figure 1:
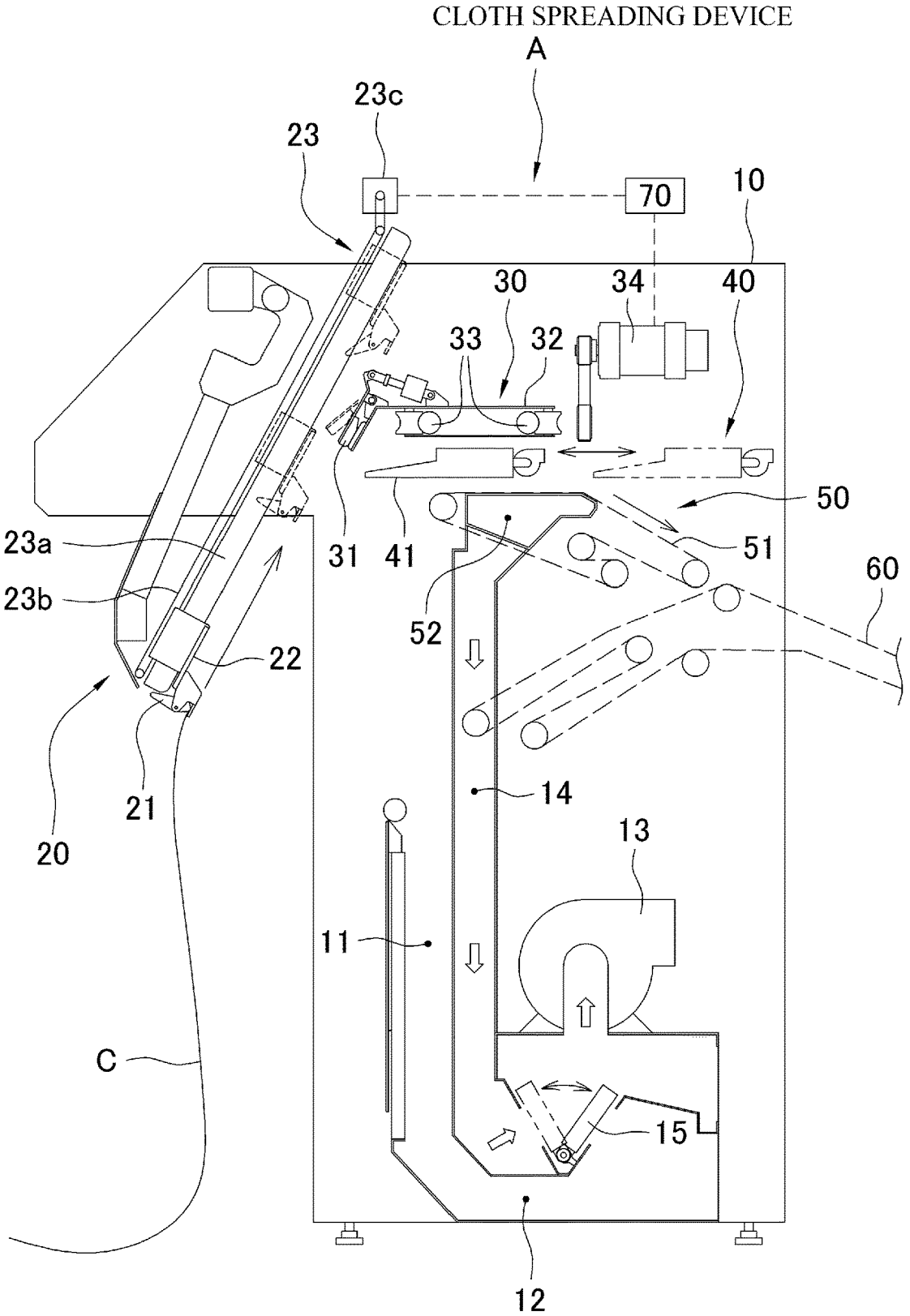
FIG. 1 is a sectional view (a sectional view taken along a line I-I of FIG. 2) of a cloth spreading device according to a first embodiment of this invention.
Figure 2:
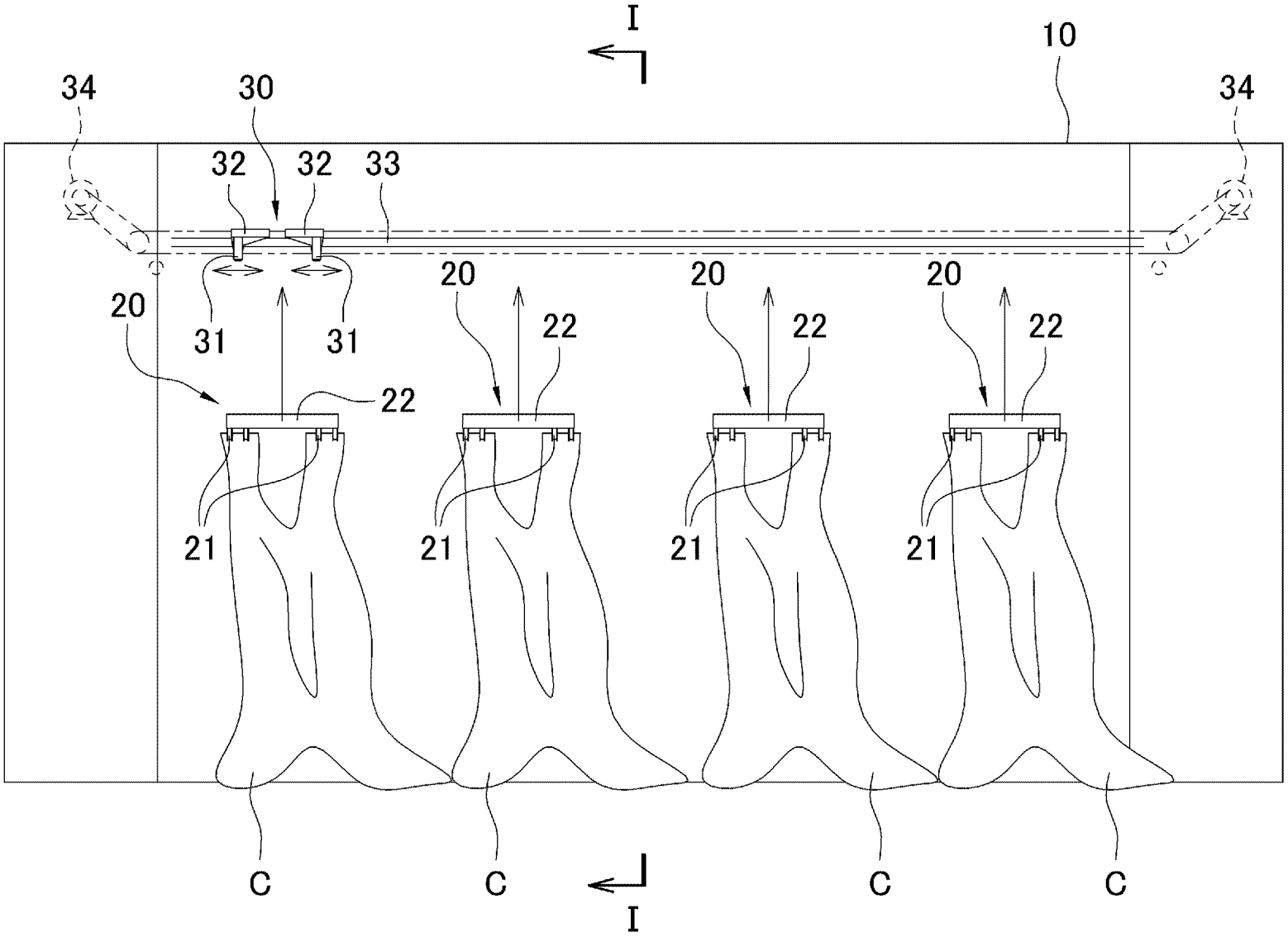
FIG. 2 is a front view of the cloth spreading device.

A basic configuration of a cloth spreading device A is described first based on FIGS. 1 and 2.

The cloth spreading device A is a device for hanging a cloth C and extending the cloth C neatly into a well arranged quadrangular shape, and for introducing the cloth C into a processing device such as a roll ironer to be used in a subsequent step. The cloth C handled by the spreading device is a cloth after being subjected to washing and drying and before being subjected to ironing. The cloth C has a quadrangular shape. This quadrangular shape includes a square shape and a rectangular shape. Examples of the cloth C include sheets, quilt covers, and towels.

A sign 10 in the drawings shows a device body. An introduction unit 20 is provided on the front side of the device body 10. The introduction unit 20 includes introduction chucks 21, 21 in a pair that grip corner portions at opposite ends of one side of a cloth C, a chuck base 22 to which the introduction chucks 21, 21 are fixed, and an up and down moving device 23 that moves the chuck base 22 up and down. The introduction chucks 21, 21 in a pair can be moved up and down by the up and down moving device 23. The chuck base 22 has a width comparable to a breadth of human shoulders. The introduction chucks 21, 21 are provided at the right end and the left end of the chuck base 22. Each of the introduction chucks 21 is formed of two right and left chucks aligned at a given interval.

If a worker makes the introduction chucks 21, 21 grip a washed and dried cloth C by hand, the up and down moving device 23 moves up the cloth C together with the introduction chucks 21, 21 to transfer the cloth C to an extension unit 30 described later.

The cloth spreading device A includes one or a plurality of introduction units 20. In this embodiment, the cloth spreading device A includes four introduction units 20 and is configured to allow introduction of a cloth C through any of the introduction units 20.

A characteristic feature of this embodiment is that the up and down moving device 23 is driven by an actuator permitting speed control and position control. Examples of an "actuator permitting speed control and position control" include servo actuators such as servomotors and servo cylinders, and stepping motors. The up and down moving device 23 of this embodiment is formed of a rod 23*a* that guides the chuck base 22 so as to move the chuck base 22 up and down, an endless belt 23*b* arranged along the rod 23*a* and fixed to the chuck base 22, and a servomotor 23*c* that rotates pulleys in a forward direction and a reverse direction around which the endless belt 23*b* is wound.

The up and down moving device 23 is driven by the actuator permitting speed control and position control. Thus, unlike an air cylinder, the operation of the up and down moving device 23 is not changed, for example by the situation of an air compressor. Further, the operating speed of the up and down moving device 23 is not changed by the weight of a cloth C. In this way, an external factor does not cause large change in the operation of the up and down moving device 23 to achieve stable upward and downward moving operations of the introduction chucks 21, 21.

By driving the up and down moving device 23 using the actuator permitting speed control and position control, the position and the speed of the introduction chucks 21, 21 can be controlled. In this way, the introduction chucks 21, 21 can be moved and stopped at will. This eliminates the need for a position sensor unlike use of an air cylinder, thereby achieving corresponding reduction in facility cost.

Further, replacing an air cylinder with the actuator permitting speed control and position control reduces emission to enhance environmental resistance, and enhances maintenance performance. This actuator achieves immediate stop for emergency shut down, thereby achieving a high level of safety.

The extension unit 30 is provided at a position corresponding to the position of an upper part of the up and down moving device 23. The extension unit 30 includes extension chucks 31, 31 in a pair that grip corner portions at opposite ends of one side of the cloth C, carriages 32, 32 in a pair to which the corresponding extension chucks 31, 31 are fixed, a rail 33 along which the carriages 32, 32 are guided so as to move to the right and left, and a transversely moving device 34 allowed to move the carriages 32 independently. The transversely moving device 34 is formed of a combination of a servomotor and an endless belt, for example. The extension chucks 31, 31 in a pair can be moved transversely and independently by the transversely moving device 34. Not only the servomotor can be used for driving the transversely moving device 34 but the transversely moving device 34 may be configured to be driven by a different actuator permitting speed control and position control.

When a cloth C moves up in response to the operation of the introduction unit 20, the extension chucks 31 receive the cloth C from the introduction chucks 21 and grip corner portions of the cloth C. At this time, each of the extension chucks 31 passes through between the two chucks forming each of the introduction chucks 21. This achieves transfer of the cloth C while preventing the extension chucks 31 and the introduction chucks 21 from interfering with each other. Then, the extension chucks 31, 31 in a pair move transversely so as to be separated to the right and left. In this way, the cloth C can be hung in an extended condition.

A transfer unit 40 is arranged below the extension unit 30. The transfer unit 40 includes a vacuum box 41 that generates a negative pressure acting to suck and hold an upper edge of a cloth C, and an air cylinder (not shown in the drawings) that moves the vacuum box 41 forward and backward.

A primary conveyor 50 is arranged below the transfer unit 40. The primary conveyor 50 includes a conveyor belt 51 with a large number of small holes, and a vacuum box 52 arranged below a conveyor surface of the conveyor belt 51. The primary conveyor 50 can feed a cloth C to a posterior side while sucking the cloth C. A secondary conveyor 60 is connected to the posterior side of the primary conveyor 50. The secondary conveyor 60 is allowed to feed the cloth C to a processing device such as a roll ironer to be used in a subsequent step.

An airflow shaping unit 11 is formed at a front lower area of the device body 10. A lower part of the airflow shaping unit 11 is connected through a duct 12 to a blower 13. A second duct 14 is formed on the back side of the airflow shaping unit 11. The duct 14 is configured to make the vacuum box 52 of the primary conveyor 50 and the blower 13 communicate each other. An on-off plate 15 is provided between the duct 12 and the blower 13 and between the duct 14 and the blower 13. The on-off plate 15 is to open either an opening of the duct 12 or an opening of the duct 14 and to close either the opening of the duct 12 or the opening of the duct 14. In this way, one of the following alternatives can be selected: a state of sucking air into the airflow shaping unit 11 through the front side of the device body 10; and a state of actuating the vacuum box 52 of the primary conveyor 50.

The cloth spreading device A includes a controller 70 that controls the operation of the up and down moving device 23 and the operation of the transversely moving device 34. The controller 70 is a computer formed of a CPU, a memory, etc. The controller 70 controls the operation of the up and down moving device 23 and the operation of the transversely moving device 34, so that the introduction chucks 21 and the extension chucks 31 are allowed to operate in a synchronized manner, as will be described in detail later.

Figure 3:
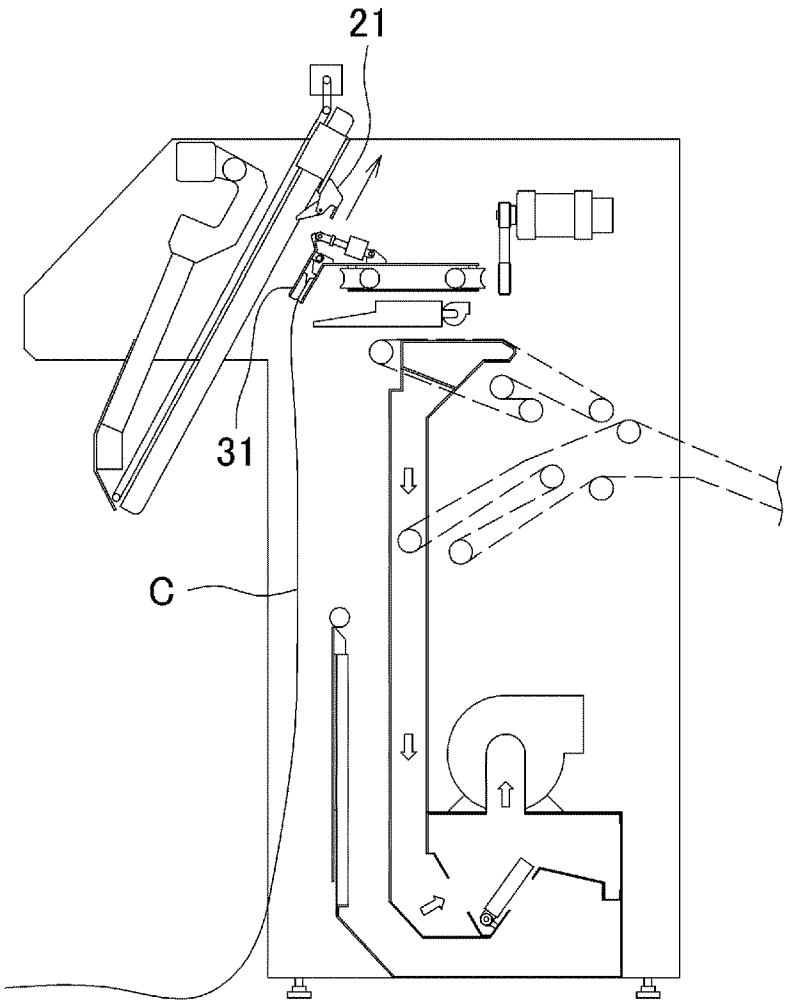
FIG. 3 explains operations in steps (I) and (II) executed by the cloth spreading device.
Figure 3:
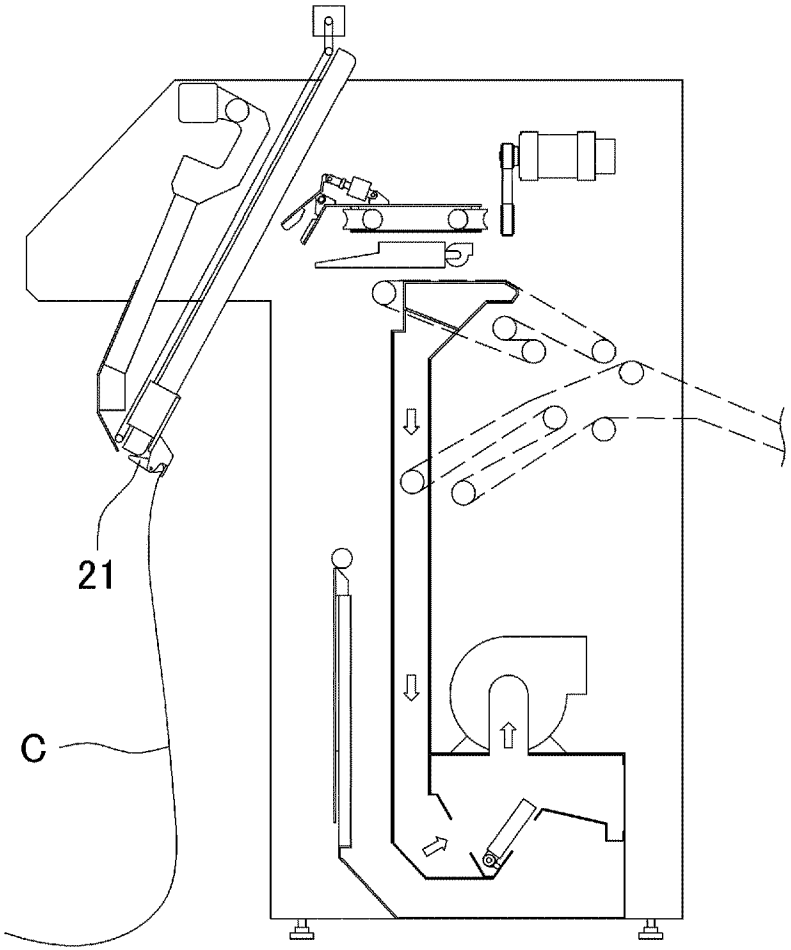
Figure 4:
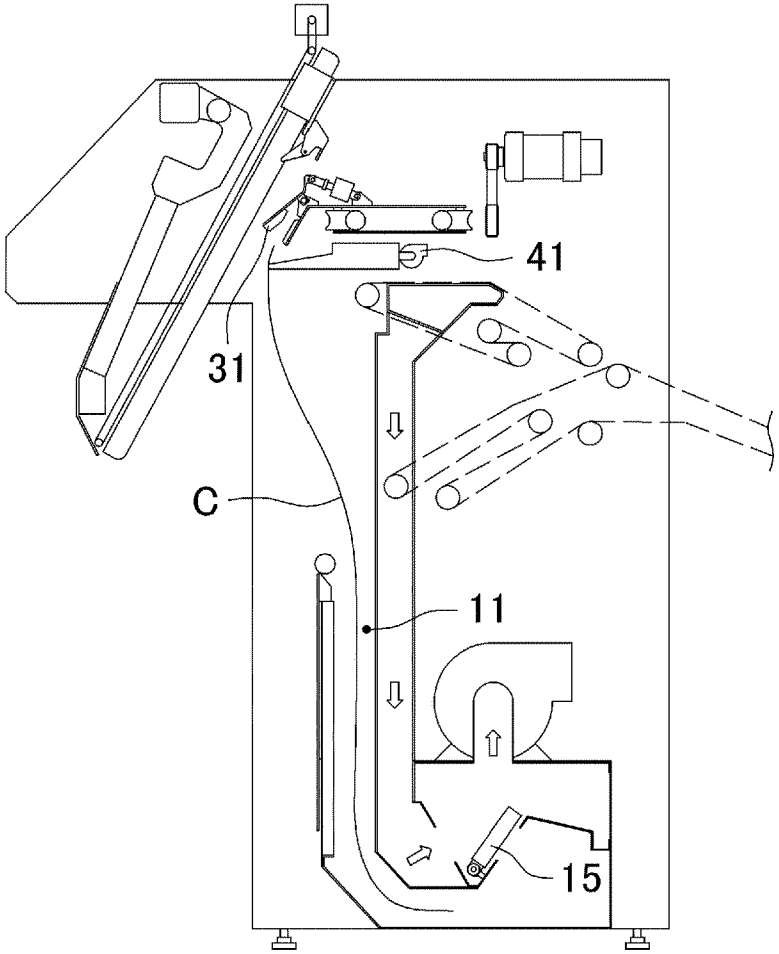
FIG. 4 explains operations in steps (III) and (IV) executed by the cloth spreading device.
Figure 4:
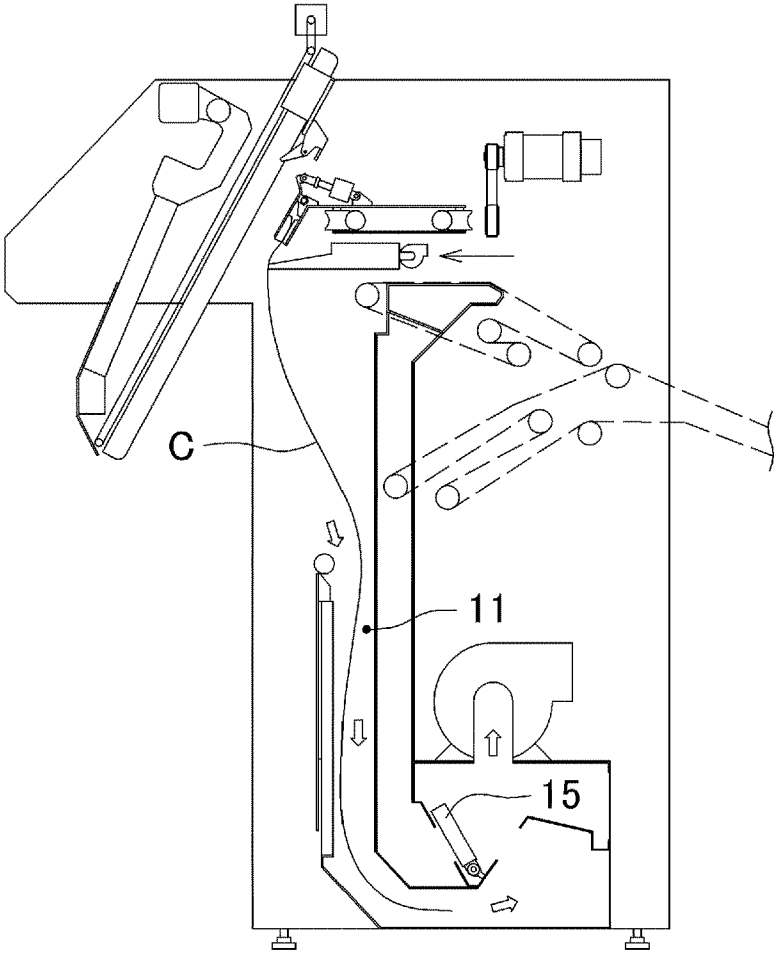
Figure 5:
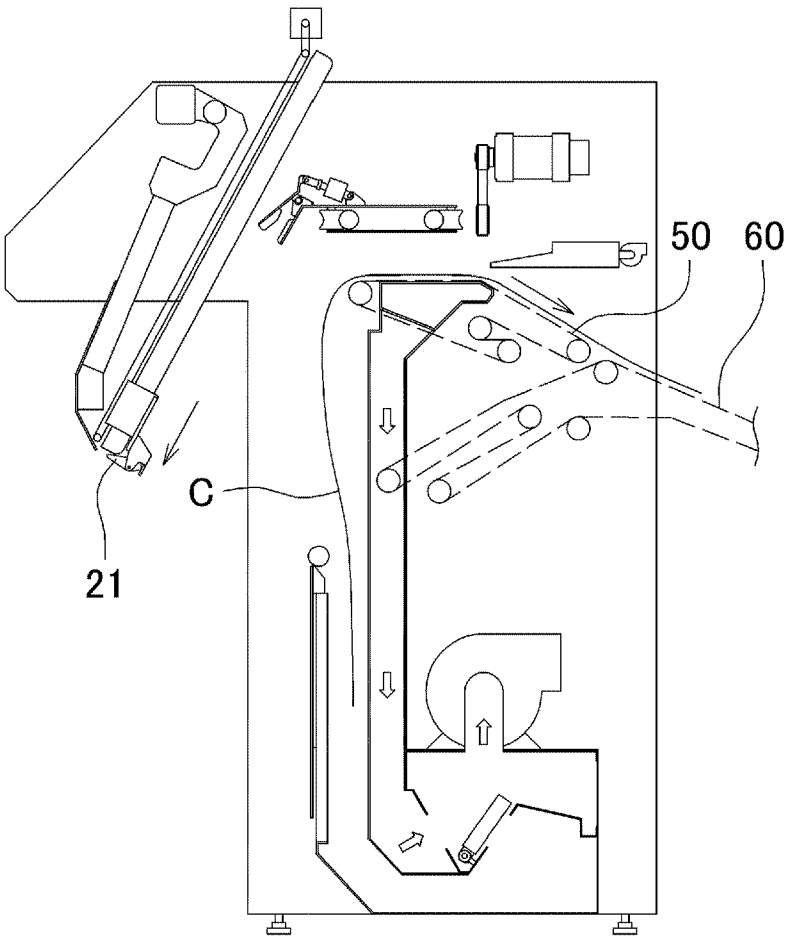
FIG. 5 explains operations in steps (V) and (VI) executed by the cloth spreading device.
Figure 5:
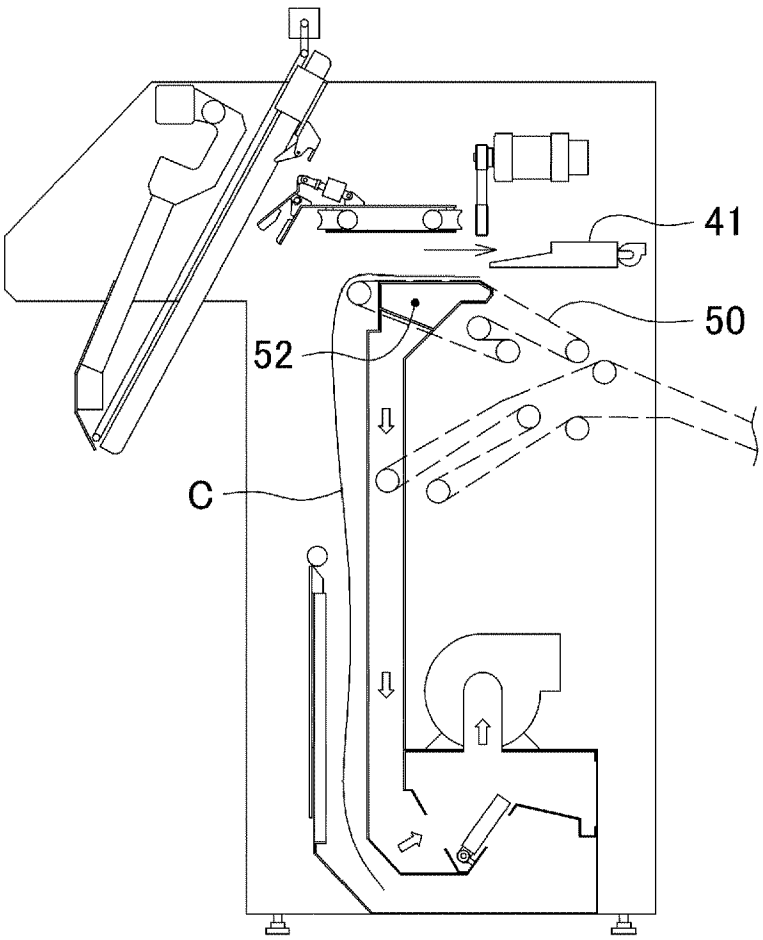

The operation of the cloth spreading device A is described next based on FIGS. 3 to 5.

(I) Introduction Work

The introduction chucks 21 are initially on standby at a low introduction position. A worker finds corner portions at opposite ends of one side of a cloth C and makes the introduction chucks 21, 21 grip the corner portions.

(II) Spreading Operation

Then, the introduction chucks 21 move up from the introduction position to a highest position. During this movement, the cloth C is transferred from the introduction chucks 21 to the extension chucks 31 at a transfer position where the introduction chucks 21 overlap the extension chucks 31. Next, the extension chucks 31 in a pair move to be separated to the right and left. In this way, the cloth C is hung in an extended condition to be spread.

(III) Retracting Operation

Next, the on-off plate 15 is switched to produce the state of sucking air into the airflow shaping unit 11. In this state, the cloth C is retracted into the airflow shaping unit 11 by a negative pressure.

(IV) Transferring Operation

When the on-off plate 15 is switched again, the airflow in the airflow shaping unit 11 stops to produce a state of facilitating pulling up of the cloth C. Further, the vacuum box 41 is moved forward to contact the cloth C and the extension chucks 31 are opened. In this way, an upper edge of the cloth C is attached under suction to the vacuum box 41.

(V) Relaying Operation

Next, the vacuum box 41 is moved back to relay the upper edge of the cloth C from the vacuum box 41 to the primary conveyor 50. During this operation, the vacuum box 52 of the primary conveyor 50 continues operating.

(VI) Outputting Operation

Next, the cloth C moves from the primary conveyor 50 to the secondary conveyor 60 and is then output to a processing device to be used in a subsequent step. Further, the introduction chucks 21 move down to the introduction position.

The characteristic feature of this embodiment lies particularly in the spreading operation (II) out of the aforementioned operations.

Figure 6:
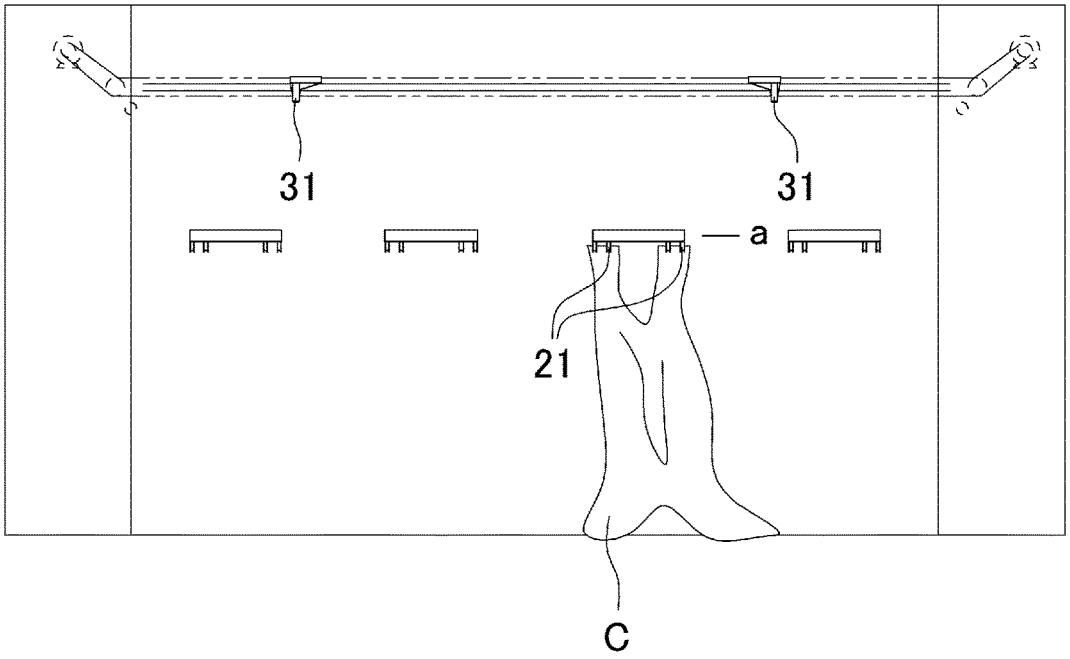
FIG. 6 explains detailed operations in steps (1) and (2) executed by the cloth spreading device.
Figure 6:
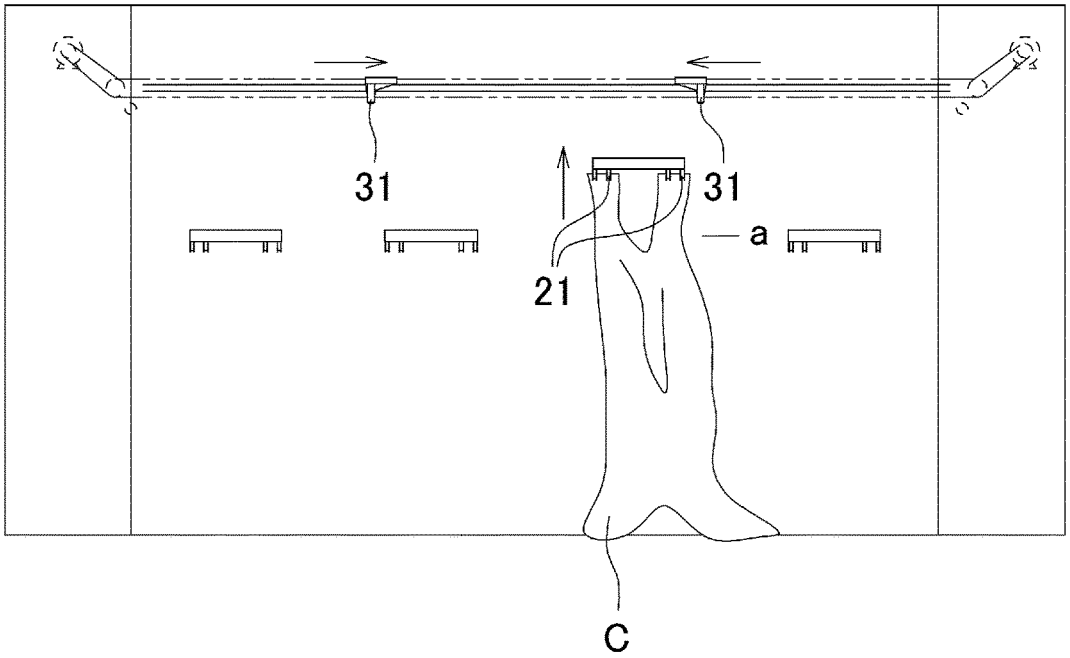
Figure 7:
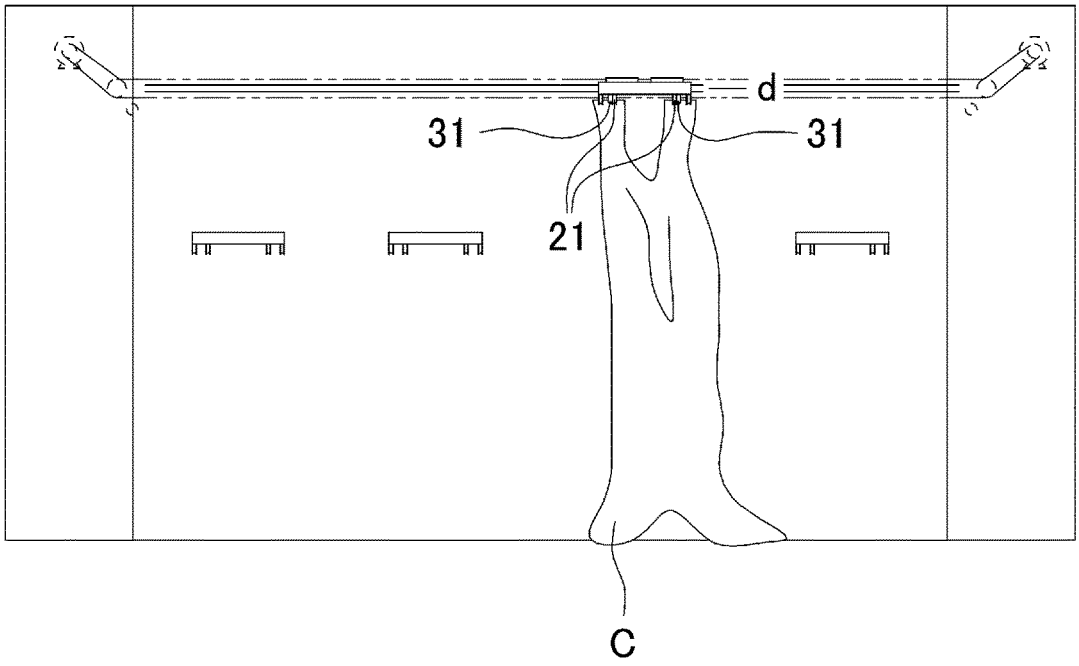
FIG. 7 explains detailed operations in steps (3) and (4) executed by the cloth spreading device.
Figure 7:
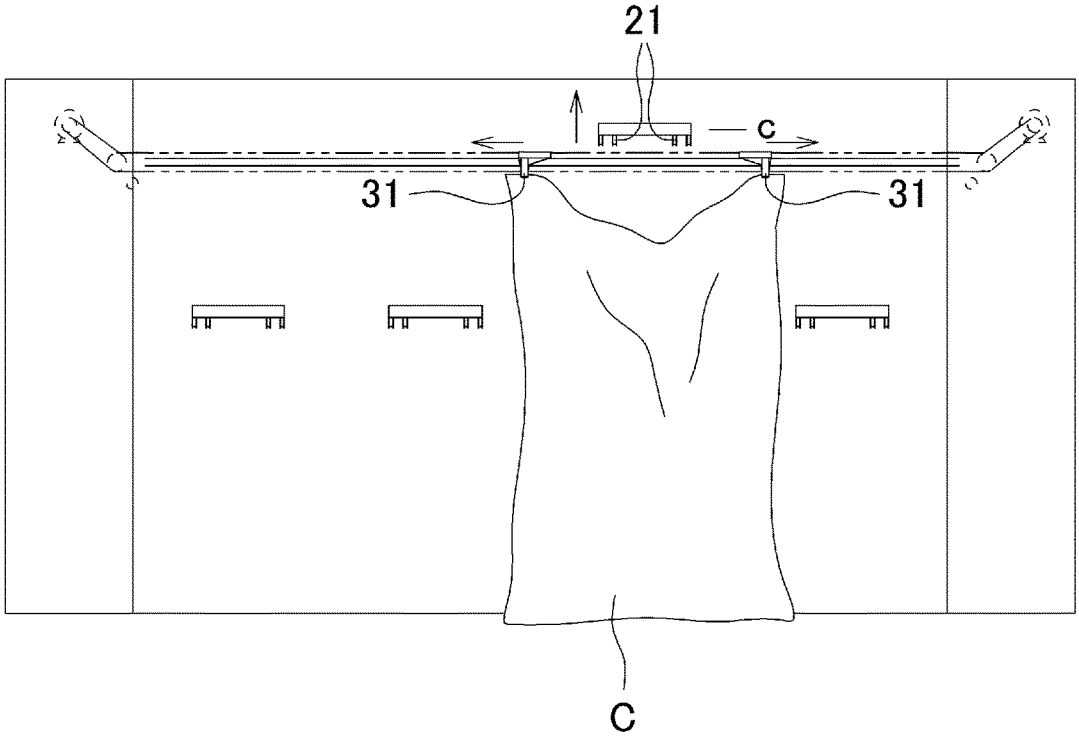
Figure 8:
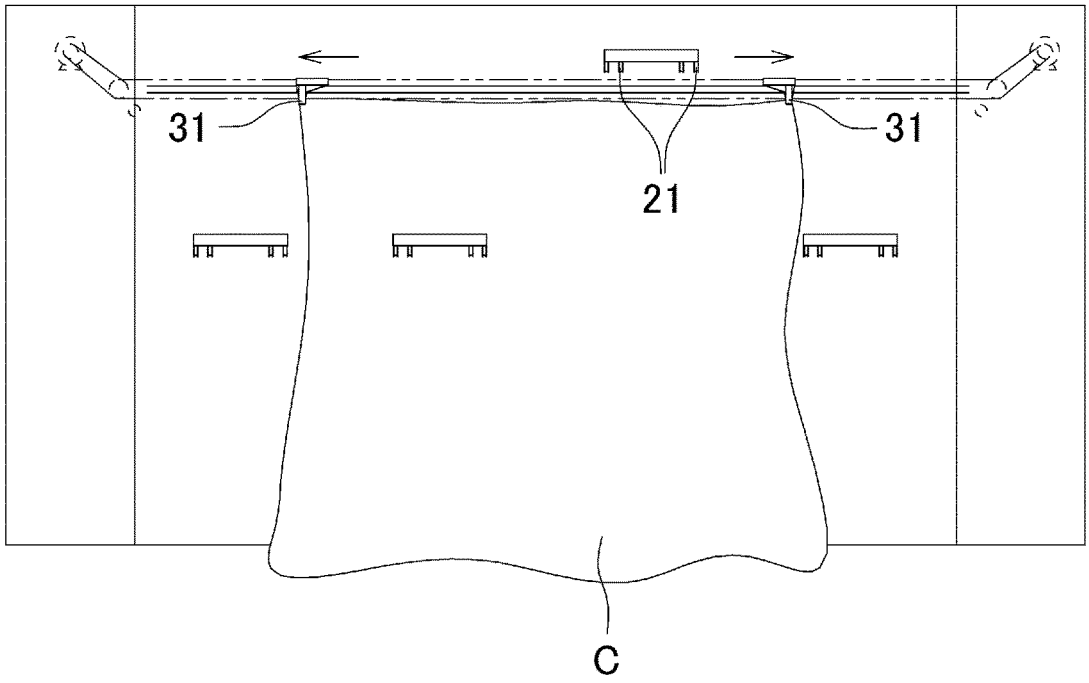
FIG. 8 explains detailed operations in steps (5) and (6) executed by the cloth spreading device.
Figure 8:
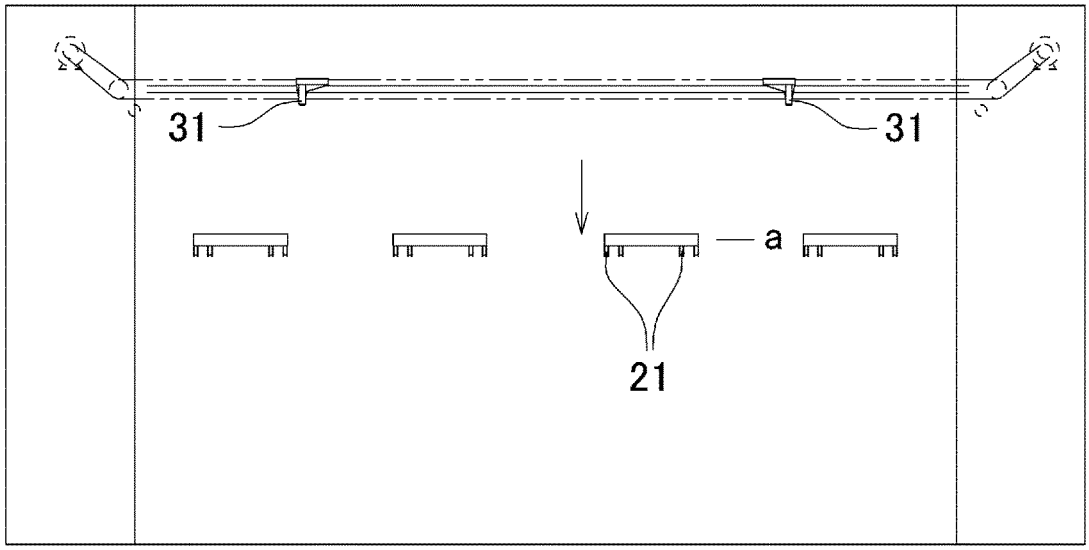
Figure 9:
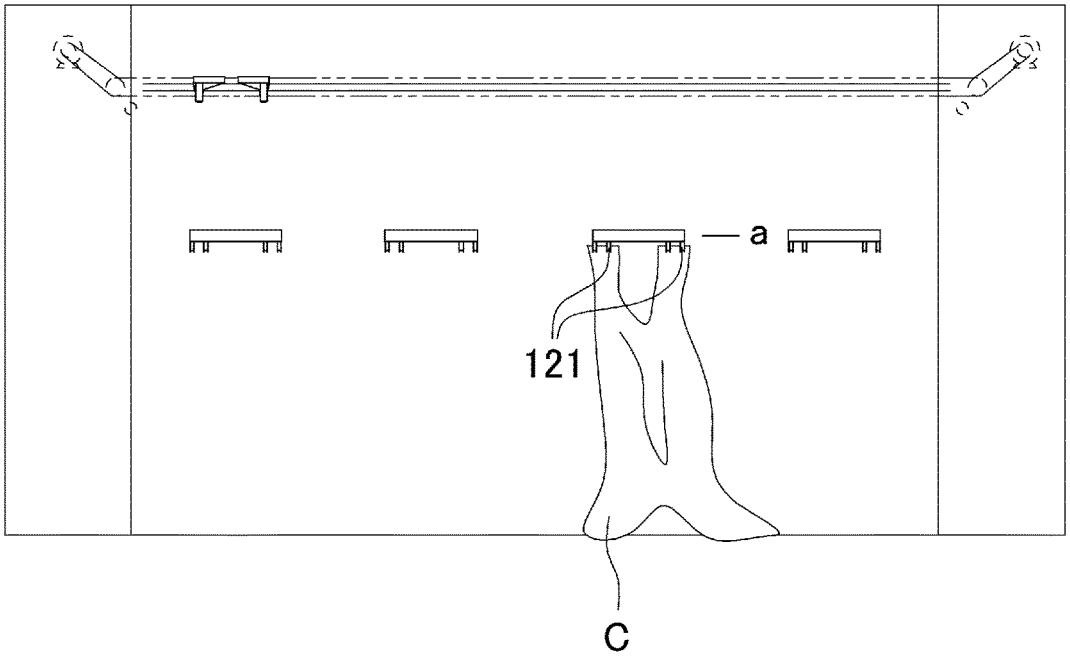
FIG. 9 explains detailed operations in steps (1) and (2) executed by a conventional cloth spreading device.
Figure 9:
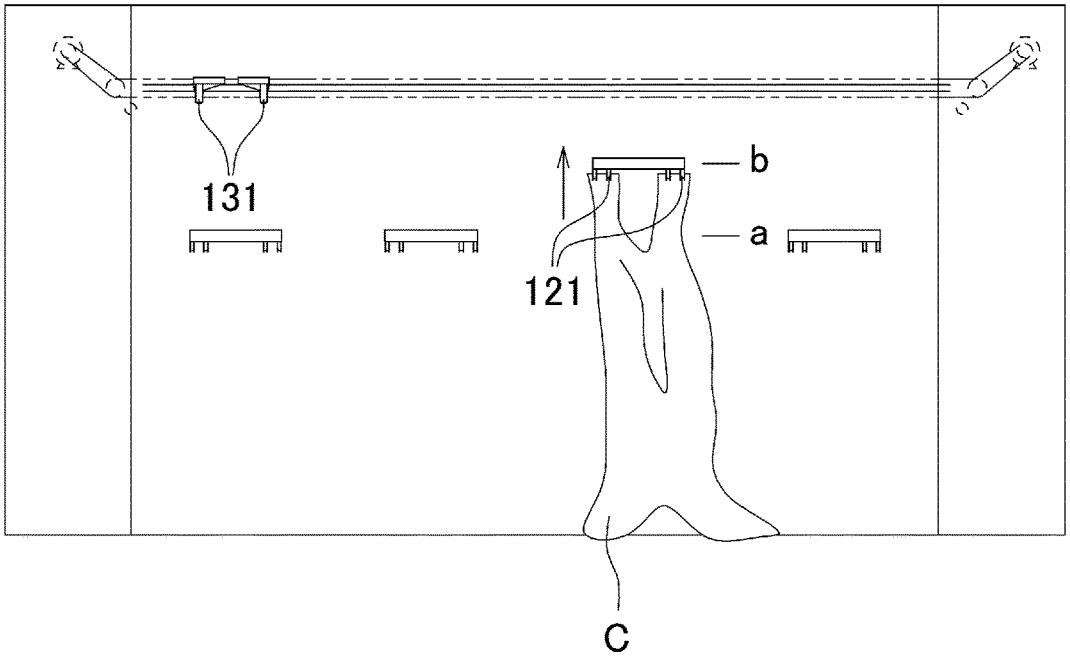
Figure 10:
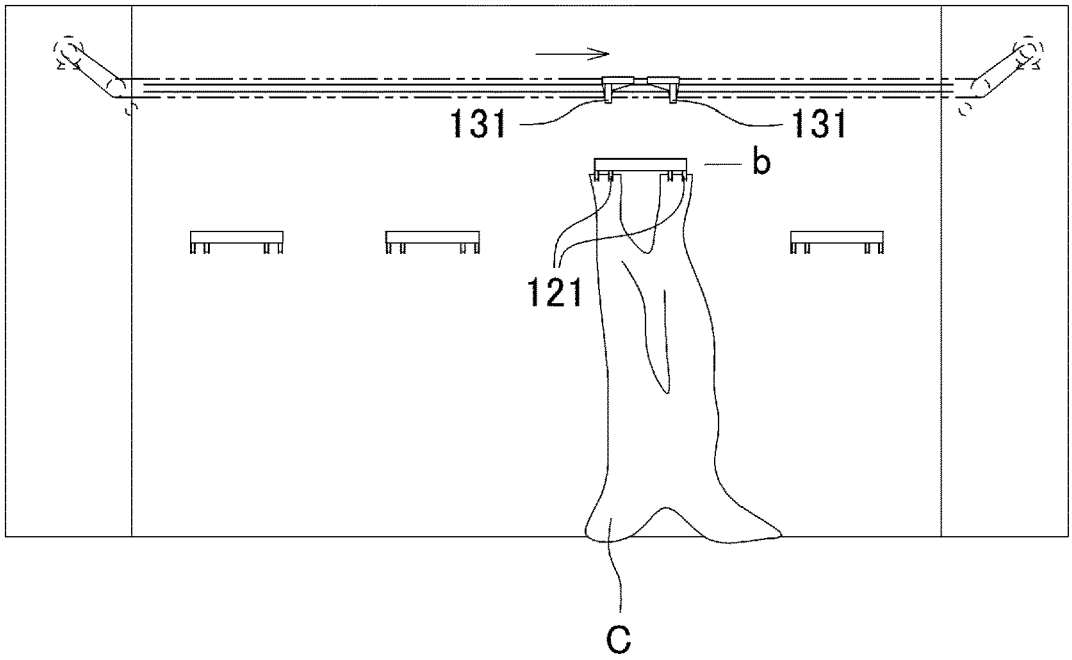
FIG. 10 explains detailed operations in steps (3) and (4) executed by the conventional cloth spreading device.
Figure 10:
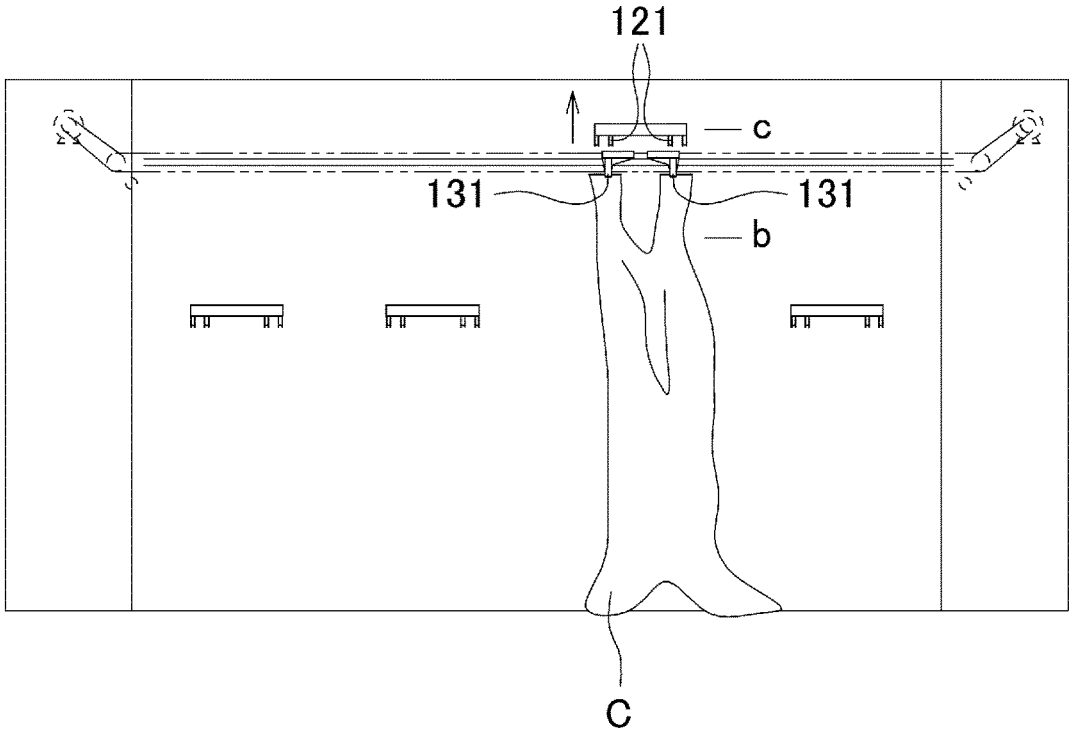
Figure 11:
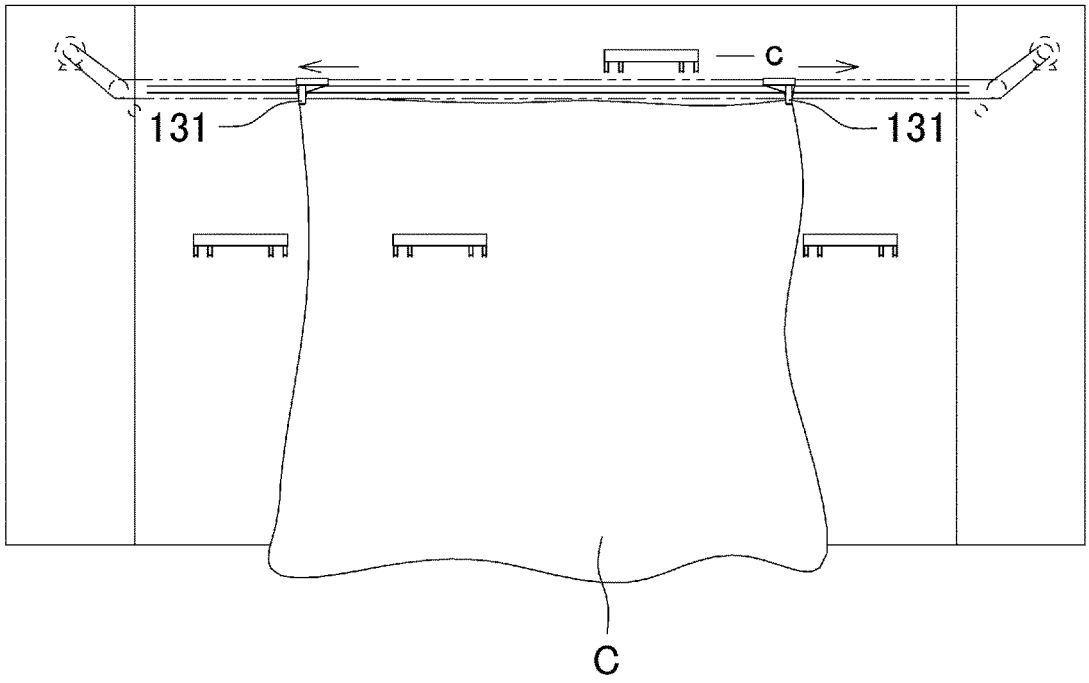
FIG. 11 explains detailed operations in steps (5) and (6) executed by the conventional cloth spreading device.
Figure 11:
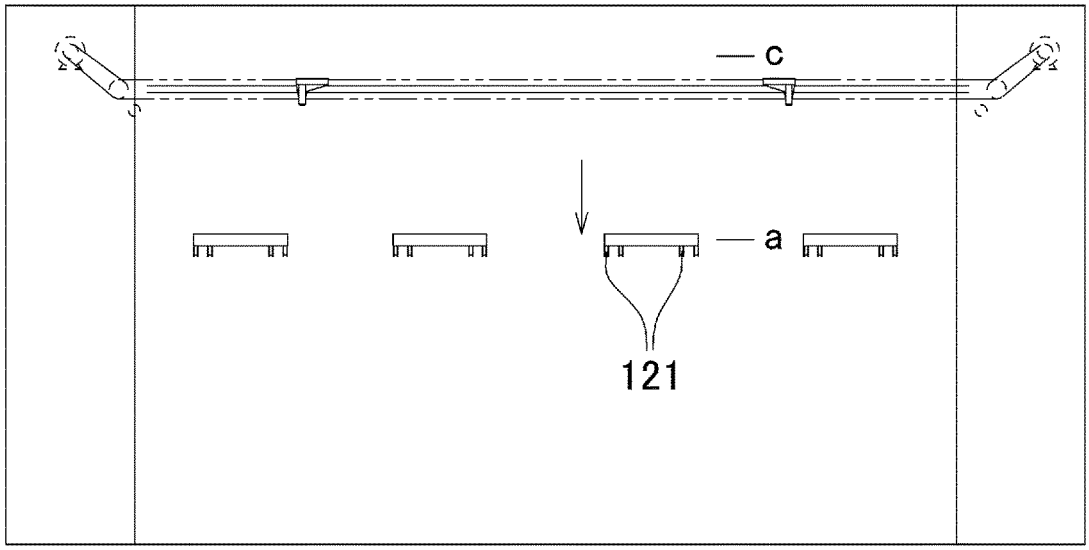

The controller 70 operates the up and down moving device 23 of the introduction unit 20 and the transversely moving device 34 of the extension unit 30, thereby operating the introduction chucks 21 and the extension chucks 31. The up and down moving device 23 and the transversely moving device 34 are driven by the actuators permitting speed control and position control, so that the position and the speed of the up and down moving device 23 and the position and the speed of the transversely moving device 34 can be controlled easily. In this way, the introduction chucks 21 and the extension chucks 31 are allowed to operate simultaneously and in a synchronized manner. These operations will be described in detail below based on FIGS. 6 to 8.

(1) The introduction chucks 21, 21 are initially on standby at a low introduction position a. The extension chucks 31, 31 are in operation of extending a different cloth C or in a standby state after finishing operation. If being in a standby state, the extension chucks 31 are on standby at a position (a position of FIG. 6(1)) while keeping extending a cloth C to the right and left or at a predetermined standby position. A worker finds corner portions at opposite ends of one side of a cloth C and makes the introduction chucks 21, 21 grip the corresponding corner portions.

(2) When the cloth C is gripped by the introduction chucks 21, 21, the controller 70 operates the up and down moving device 23 and the transversely moving device 34 simultaneously. This moves up the introduction chucks 21 from the introduction position a to a transfer position d, while moving the extension chucks 31 transversely to the transfer position d.

(3) When both the introduction chucks 21 and the extension chucks 31 arrive at the transfer position d, the cloth C gripped by the introduction chucks 21 is transferred to the extension chucks 31.

In the aforementioned steps from (2) to (3), the introduction chucks 21 and the extension chucks 31 operate simultaneously. To "operate simultaneously" mentioned herein is satisfied only if the introduction chucks 21 or the extension chucks 31 operate in a period when the other chucks operate. The introduction chucks 21 and the extension chucks 31 are not required to be timed to start operating or stop operating simultaneously.

The cloth spreading device A includes the four introduction units 20 and a cloth C can be introduced into the cloth spreading device A through any of these introduction units 20. One extension unit 30 is prepared for these four introduction units 20 and processes clothes C introduced into the corresponding introduction units 20 in order. Thus, at a time when a cloth C is introduced into one introduction unit 20, the extension unit 30 may be in operation of transferring a cloth C having been introduced into a different introduction unit 20 or in operation of extending such a cloth C. In such cases, upward movement of the introduction chucks 21 may be started first and transverse movement of the extension chucks 31 may be started after operation of extending the different cloth C is finished.

In this embodiment, each introduction chuck 21 is formed of the two right and left chucks aligned at a given interval and each extension chuck 31 passes through between these two chucks. This achieves transfer of a cloth C between the extension chucks 31 and the introduction chucks 21 while preventing the extension chucks 31 and the introduction chucks 21 from interfering with each other. Thus, during transfer of the cloth C, while the extension chucks 31 are stopped at the transfer position d, the introduction chucks 21 are operated so as to pass through the transfer position d. For such operations, the extension chucks 31 should arrive at the transfer position d before the introduction chucks 21. To make the extension chucks 31 arrive at the transfer position d before the introduction chucks 21, the speed of the introduction chucks 21 and the speed of the extension chucks 31 may be adjusted, or the introduction chucks 21 may be stopped temporarily before arriving at the transfer position d.

As described above, in the conventional cloth spreading device, the introduction chucks are moved up after the extension chucks arrive at the transfer position, so that the extension chucks and the introduction chucks are not operated simultaneously. By contrast, according to this embodiment, the introduction chucks 21 and the extension chucks 31 can be operated simultaneously for arrival at the transfer position d. Thus, no wasting time is generated from introduction of a cloth C to transfer of the cloth C, thereby increasing a processing speed.

(4) After the cloth C is transferred, the controller 70 operates the up and down moving device 23 and the transversely moving device 34 simultaneously to move up the introduction chucks 21, 21 from the transfer position d to a high position c and move the extension chucks 31, 31 transversely to the right and left from the transfer position d.

(5) The extension chucks 31, 31 in a pair are moved to be separated to the right and left to spread the cloth C.

(6) After the cloth C is transferred from the extension chucks 31 to the transfer unit 40, the introduction chucks 21 are moved down from the high position c to the introduction position a.

In the aforementioned steps from (4) to (5), the introduction chucks 21 and the extension chucks 31 also operate simultaneously. This is also satisfied only if the introduction chucks 21 or the extension chucks 31 operate in a period when the other chucks operate. The introduction chucks 21 and the extension chucks 31 are not required to be timed to start operating or stop operating simultaneously. After the introduction chucks 21 move up to a position not interfering with the extension chucks 31, the extension chucks 31 start moving transversely. A distance of the transverse movement of the extension chucks 31 is generally longer than a distance of the upward movement of the introduction chucks 21. Thus, the extension chucks 31 continue moving transversely after the introduction chucks 21 arrive at the high position c and then stop.

As described above, in the conventional cloth spreading device, the extension chucks move transversely after the introduction chucks arrive at the high position, so that the extension chucks and the introduction chucks are not operated simultaneously. By contrast, according to this embodiment, the introduction chucks 21 and the extension chucks 31 can be operated simultaneously for movement from the transfer position d. Thus, no wasting time is generated from transfer of a cloth C to spreading of the cloth C, thereby increasing a processing speed.

Preferably, in the aforementioned step (6), the speed of the downward movement of the introduction chucks 21 is changed during the downward movement so as to be increased in a predetermined period after the introduction chucks 21 start moving down and to be reduced in a predetermined period before the introduction chucks 21 finish moving down. Increasing the speed of the downward movement in the predetermined period after the introduction chucks 21 start moving down can shorten time required for the introduction chucks 21 to return to the introduction position a. As a result, a processing speed can be increased. Reducing the speed of the downward movement in the predetermined period before the introduction chucks 21 finish moving down, specifically, when the introduction chucks 21 are near the introduction position a, can reduce the risk of injury of a worker due to collision with the introduction chucks 21 moving down. Such speed control is achieved by driving the up and down moving device 23 using the actuator permitting speed control and position control.

Second Embodiment

The introduction chucks 21 are on standby at the low introduction position a for gripping a cloth C. The introduction position a may be set at an adjustable height. According to this embodiment, the cloth spreading device A according to the first embodiment is configured in such a manner that an input device is connected to the controller 70 and the introduction position a can be input through the input device. The introduction position a input through the input device is input and stored in the controller 70. The controller 70 controls the operation of the up and down moving device 23 to place the introduction chucks 21 on standby at the stored introduction position a during introduction of a cloth C.

According to this embodiment, the introduction position a can be adjusted so as to conform to the height of a worker. This can reduce a workload on the worker. In this way, the introduction position a can be adjusted freely by using the actuator permitting speed control and position control for driving the up and down moving device 23.

REFERENCE SINGS LIST

A Cloth spreading device
C Cloth
10 Device body
20 Introduction unit
21 Introduction chuck
22 Chuck base
23 Up and down moving device
23*a* Rod
23*b* Endless belt
23*c* Servomotor
30 Extension unit
31 Extension chuck
32 Carriage
33 Rail
34 Transversely moving device
40 Transfer unit
50 Primary conveyor
60 Secondary conveyor
70 Controller

The invention claimed is:

1. A cloth spreading device comprising:

introduction chucks in a pair that grip corner portions of a cloth;

an up and down moving device that moves the introduction chucks in a pair up and down;

extension chucks in a pair that receive the cloth from the introduction chucks in a pair and grip corner portions of the cloth;

a transversely moving device that moves the extension chucks in a pair transversely, a controller that controls the operation of the up and down moving device; and an input device for input of an introduction position to the controller, the introduction position being a position where the cloth is gripped by the introduction chucks, wherein the up and down moving device is driven by an actuator permitting speed control and position control, the controller controls the operation of the up and down moving device to place the introduction chucks on standby at the introduction position during introduction of the cloth.

* * * * *